US006717552B2

(12) United States Patent
Desargant et al.

(10) Patent No.: US 6,717,552 B2
(45) Date of Patent: Apr. 6, 2004

(54) COMMUNICATIONS ANTENNA SYSTEM AND MOBILE TRANSMIT AND RECEIVE REFLECTOR ANTENNA

(75) Inventors: Glen J. Desargant, Fullerton, CA (US); Albert Louis Bien, Anaheim, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/041,697

(22) Filed: Jan. 8, 2002

(65) Prior Publication Data

US 2003/0128168 A1 Jul. 10, 2003

(51) Int. Cl.[7] ..... H01Q 13/00

(52) U.S. Cl. ..... 343/781 P; 343/781 R; 343/713; 343/754

(58) Field of Search ..... 343/781 P, 781 CA, 343/757, 765, 766, 786, 840, 754, 713, 781 R

(56) References Cited

U.S. PATENT DOCUMENTS

| | | | | |
|---|---|---|---|---|
| 3,235,870 A | * | 2/1966 | Hannan | 343/781 R |
| 4,338,607 A | * | 7/1982 | Drabowitch | 343/754 |
| 4,498,061 A | * | 2/1985 | Morz et al. | 343/756 |
| 5,398,035 A | * | 3/1995 | Densmore et al. | 343/713 |
| 5,793,335 A | * | 8/1998 | Anderson et al. | 343/786 |
| 6,087,985 A | * | 7/2000 | Rummeli et al. | 343/757 |
| 6,184,840 B1 | * | 2/2001 | Hsin-Loug et al. | 343/781 P |

FOREIGN PATENT DOCUMENTS

| | | | |
|---|---|---|---|
| DE | 1 296 221 | 5/1969 | |
| EP | 0 638 821 A1 | 8/1994 | G01S/13/89 |

OTHER PUBLICATIONS

Publication entitled "Microwave Feed Systems For NASA's Beam–Waveguide Reflector Antennas" by F. Manshadi; 1993.

Publication entitled Implementation Of Polarmetric Capability for the WSR–88D (NEXRAD) Radar by Allen Zahrai and Dr. Dusan Zrnic; 1997.

* cited by examiner

*Primary Examiner*—Hoang V. Nguyen
(74) *Attorney, Agent, or Firm*—Harness Dickey & Pierce P.L.C.

(57) ABSTRACT

A reflector antenna adapted for use with a mobile platform, in particular with an aircraft. The reflector antenna includes an antenna aperture, a first signal processing subsystem located closely adjacent the antenna aperture exteriorly of the mobile platform, a two channel coaxial rotary joint for allowing rotation of the antenna aperture about an azimuthal axis, and a second antenna signal processing subsystem located within the interior of the mobile platform. A feedhorn of the antenna aperture is disposed within an opening at a coaxial center of a main reflector to allow a longer length feedhorn to be employed without physically interfering with a subreflector of the antenna aperture. The first antenna signal processing subsystem includes separate channels for processing vertically polarized RF energy and horizontally polarized RF energy. The second antenna signal processing subsystem includes a transmit subsystem for amplifying and phase shifting transmit signals being sent to the antenna aperture for transmission, and a receive subsystem for processing received RF signals to provide right hand circularly polarized and left hand circularly polarized signals.

19 Claims, 1 Drawing Sheet

COMMUNICATIONS ANTENNA SYSTEM AND MOBILE TRANSMIT AND RECEIVE REFLECTOR ANTENNA

TECHNICAL FIELD

The present invention relates to antenna systems, and more particularly to a reflector antenna adapted to be disposed on an exterior surface of a moving platform such as an aircraft, and further which includes certain signal processing components being located closely adjacent to an antenna aperture on an exterior surface of the mobile platform and certain signal processing components being located within the interior of the mobile platform.

BACKGROUND OF THE INVENTION

Antenna systems are used in a variety of applications. One application which is growing in importance is in connection with satellite linked communication systems for providing Internet connectivity with mobile platforms such as aircraft. In such applications, the antenna system disposed on the aircraft must present a package which is low in height and width when mounted on an exterior surface of the fuselage of the aircraft so that the antenna system does not adversely affect the aerodynamics of the aircraft. Nevertheless, such antennas must still provide a high gain/temperature (G/T) and include an antenna aperture which is capable of being rotated along an azimuthal axis as well as an elevation axis such that the antenna can be pointed in a desired direction.

Still another consideration with such antennas is the location of certain signal processing components. It would be desirable to locate certain signal processing components within the interior of the mobile platform. This would make such components easily accessible in the event repair or maintenance is required on the antenna system. Conversely, it would be desirable to locate other components, such as low noise amplifiers, close to the antenna aperture. This would help to ensure that the antenna achieves a high G/T.

With reflector antennas such as a cassegrain system, an additional problem is posed with the length of the feedhorn employed. The feedhorn may need to have a particular length which is required to efficiently illuminate the sub-reflector and to minimize the spillover energy pass the sub-reflector which provides high sidelobes in the transmit and receive antenna patterns. However, the feedhorn must still be short enough such that it does not create an antenna which has an unacceptably high profile, and thus an unacceptable aerodynamic drag and if disposed on fast moving mobile platforms such as jet aircraft.

It is therefore a principal object of the present invention to provide an antenna system which is particularly well adapted to be mounted on an exterior surface of a mobile platform, such as an aircraft, and which presents a low profile which is aerodynamically efficient. It is a further object of the present invention to provide such an antenna system which includes certain components mounted exteriorly of the mobile platform and certain other components which are mounted inside the mobile platform. In this manner, those components which need to be located physically close to the antenna aperture to maximize antenna performance can be so located, while other components which do not need to be located close to the antenna aperture can be disposed within the interior of the mobile platform for easy servicing and/or maintenance.

SUMMARY OF THE INVENTION

The above and other objects are provided by a transmit/receive (TX/RX) reflector antenna system in accordance with a preferred embodiment of the present invention. The TX/RX reflector antenna system includes an antenna aperture comprised of a main reflector, a sub-reflector and a feedhorn. The feedhorn is disposed within an aperture at an axial center of the main reflector such that a portion of the feedhorn extends forwardly of the main reflector while a portion extends rearwardly of the main reflector. In this manner, a longer feedhorn can be employed without producing an antenna that has an unacceptably large, cross-sectional profile which would therefore be aerodynamically inefficient on a fast moving mobile platform such as a jet aircraft.

In one preferred embodiment a first antenna signal processing subsystem is disposed closely adjacent to the antenna aperture exteriorly of the mobile platform under a radome, while a second antenna signal processing subsystem is disposed within the interior of the mobile platform. The two subsystems are coupled by a rotary joint, which in one preferred form comprises a two channel coaxial rotary joint. The first antenna signal processing subsystem includes two pairs of diplexers. The first pair is used to process vertically polarized RF energy while the second pair is used to process horizontally polarized RF energy. A suitable transducer in communication with the feedhorn splits circularly polarized (RHCP and LHCP) RF signals received by the antenna aperture into vertical and horizontal components for signal processing. In addition, the transducer, during a transmit function, accepts vertical and horizontal components of variable phase angle which are fed into the feedhorn to produce a linear polarization with variable angle.

The second antenna signal processing subsystem also includes a third pair of diplexers. One of this third pair of diplexers is used in a transmit subsystem and the other of the third pair is used in a receive subsystem. The transmit subsystem further includes at least one high power amplifier along with at least one phase shifter for amplifying and phase shifting a transmit signal being sent to the antenna aperture. The receive subsystem includes at least one band-pass filter for filtering signals received by the antenna aperture. Each of the transmit and receive subsystems further includes a hybrid circuit for interfacing with one of a transmit input or a receive output of the second antenna signal processing subsystem.

The first antenna signal processing subsystem further includes at least one, and preferably a pair, of low noise amplifiers. The low noise amplifiers are disposed closely adjacent to the main reflector to thus enable the antenna system to achieve a high gain/temperature (G/T). The high power amplifiers of the second antenna signal processing subsystem are disposed within the mobile platform and are thus available for convenient access in the event of needed maintenance or service. Locating the components of the second antenna signal processing subsystem within the mobile platform further helps to limit the physical size of the antenna structure which must be disposed on the exterior of the mobile platform, and thus helps to ensure that the aerodynamics of the mobile platform are not adversely affected by the presence of such components.

DETAILED DESCRIPTION OF THE PREFERRED EMBODIMENTS

Figure 1:
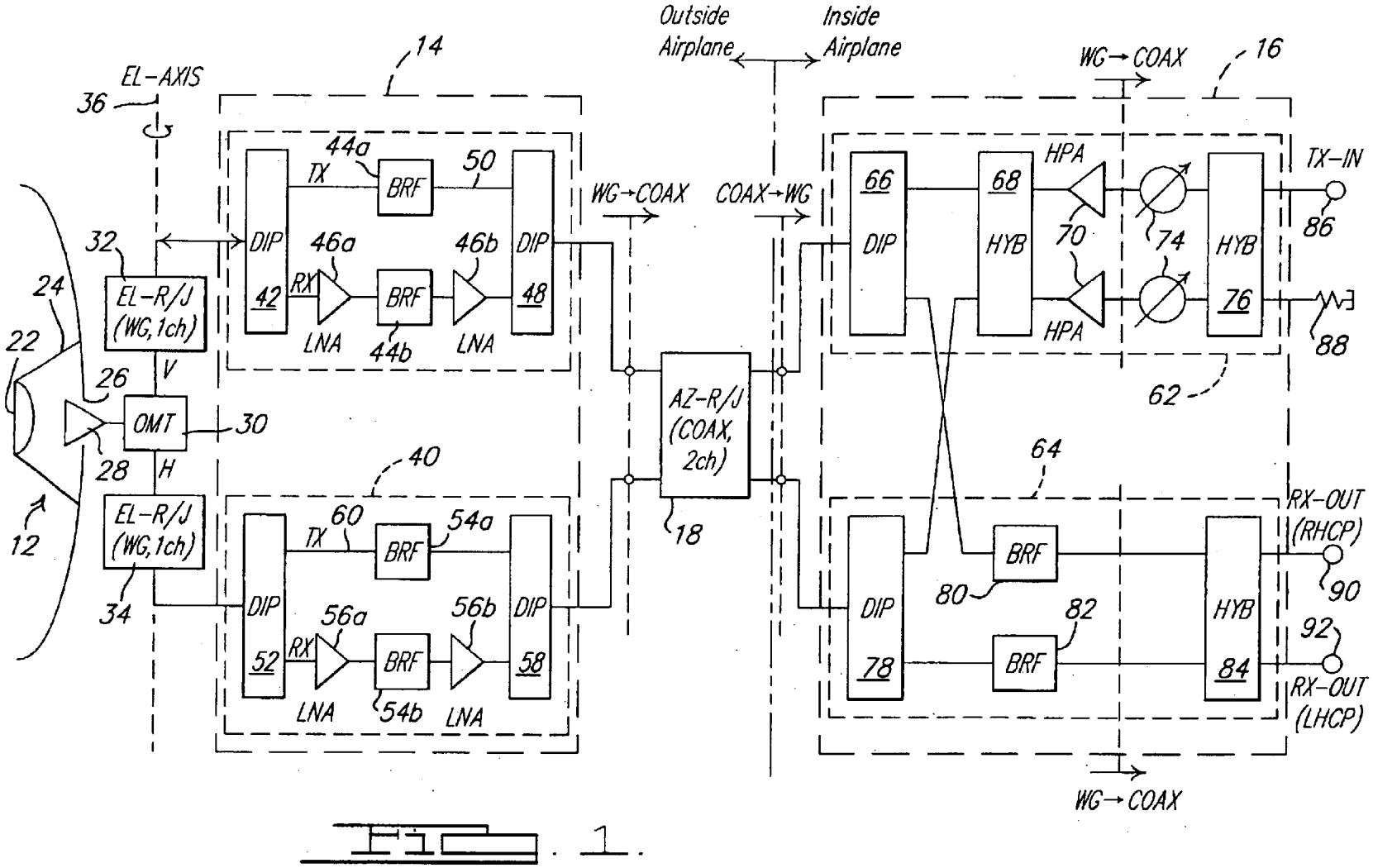
FIG. 1 is a simplified block diagram of an antenna system in accordance with a preferred embodiment of the present invention.

Referring to FIG. 1, there is shown an antenna system 10 in accordance with a preferred embodiment of the present invention. The antenna system 10 generally comprises an antenna aperture 12, a first antenna signal processing subsystem 14, a second signal antenna signal processing subsystem 16 and a suitable rotary joint 18 for facilitating bi-directional communication between the first and second subsystems 14 and 16, respectively.

The antenna aperture 12 comprises a main reflector 20, a subreflector 22 supported forwardly of the main reflector 20 by a support structure 24, and an aperture 26 disposed at an axial center of the main reflector 20. Positioned within the aperture 26 is a feedhorn 28. In a preferred form, the feedhorn 28 has a length of preferably 70 millimeters. However, the construction of the main reflector 20 and the subreflector 22, which comprises a pre-existing component, does not allow for a feedhorn of such a length. This problem is overcome by disposing the feedhorn 28 within the aperture 26 such that the first portion of the feedhorn projects forwardly of the main reflector 20 (i.e., towards the subreflector 22) while a second portion of the feedhorn projects rearwardly of the main reflector 20. The use of the feedhorn 28 having a length of about 70 millimeters allows the side-lobes of signals transmitted by the antenna aperture 12 to be minimized. Disposing the feedhorn 28 within the aperture 26 also serves to allow the cross-sectional height of the antenna aperture 12 to be maintained at a relatively low height which does not adversely affect the aerodynamics of the mobile platform on which the antenna aperture 12 is mounted.

Referring to FIG. 1, the feedhorn 26 is coupled to a transducer 30 which operates to split RF signals transmitted and received by the antenna aperture 12 into vertically polarized RF energy and horizontally polarized RF energy. In one preferred form the transducer 30 comprises an ortho mode transducer (OMT). A pair of single channel rotary joints 32 and 34 are coupled to the transducer 30 for allowing movement of the antenna aperture 12 about its elevation axis 36.

The first antenna signal processing subsystem 14 includes a first channel 38 for processing vertically polarized RF energy either being received by the antenna aperture 12 or being transmitted by the antenna aperture 12. A second channel 40 processes horizontally polarized RF energy which is either received by the antenna aperture 12 or which is being transmitted by the antenna aperture 12. The first channel 38 includes a diplexer 42, a pair of bandpass filters (BPF) 44*a* and 44*b*, a pair of low noise amplifiers (LNA) 46*a* and 46*b*, and a second diplexer 48. Components 44*b* and 46 form a "receive leg" of the channel 38. The diplexer 42 operates to split, transmit and receive signals by frequency, with the receive signals being directed through components 44*b*, 46, and 48. In one preferred form, the receive signals have a frequency of between about 11.2 GHz–12.7 GHz. The bandpass filter 44 filters out signals outside of this frequency range before same are amplified by the LNA 46*b*. The receive signals are then recombined in diplexer 48 before being output to the rotary joint 18. Circuit line 50 of the first channel 38 and bandpass filter 44*a* form a "transmit" leg which allows transmit signals to be passed from diplexer 48, through filter 44*a*, to diplexer 42, and from diplexer 42 through the transducer 30 to the antenna aperture 12.

Diplexers 42 and 52 thus perform the important function of splitting the transmit and receive signals, which then allows them to be amplified by the LNAs 46 and 56. Since the LNAs 46 and 56 are located adjacent the main reflector 20, a high gain/temperature can thus be achieved.

With further reference to FIG. 1, the second channel 40 also includes a diplexer 52, a bandpass filter 54*b*, low noise amplifiers 56*a* and 56*b*, a second diplexer 58 and a circuit line 60 having a bandpass filter 54*a*. The second channel 40 operates in identical fashion to the first channel 38 but only with horizontally polarized RF energy. The entire first antenna signal processing subsystem 14 is positioned closely adjacent main reflector 20 of the antenna aperture 12 exteriorly of the mobile platform. Locating the low noise amplifiers 46 and 56 closely adjacent the main reflector 20 allows the antenna system 10 to realize a high gain/temperature (G/T).

The second antenna processing subsystem 16 is disposed within the interior of the mobile platform and includes a transmit subsystem 62 and a receive subsystem 64. The transmit subsystem 62 includes a diplexer 66, a hybrid circuit 68, a pair of high power amplifiers (HPA) 70 and 72, a pair of variable phase shifters 74 and a hybrid circuit 76. The receive subsystem 64 includes a diplexer 78, a pair of bandpass filters 80 and 82, and a hybrid circuit 84. Advantageously, the high power amplifiers (HPA) 70 within the second signal processing subsystem 16 are located within the mobile platform so that the components thereof can be easily accessed for service and/or maintenance.

The transmit subsystem 62 separates the transmit (TX) signal into two orthogonal components with variable relative phase angles and amplifies the two orthogonal TX signals before same are fed into the hybrid circuit 68 and diplexer 78. Point 88 is a termination for the hybrid 76 and input 86 is provided for receiving a transmit input signal. The receive subsystem 64 is used to filter RF signals received by the antenna aperture 12 and transmitted through the rotary joint 18. The hybrid circuit 84 includes a first output 90 for providing a right hand circularly polarized signal and output 92 which provides a left hand circularly polarized signal. Diplexer 66 functions to provide vertically polarized RF energy received from the rotary joint 18 into the bandpass filter 80, while diplexer 78 allows horizontally polarized RF energy received from the second channel 40 of the first antenna signal processing subsystem 14 to be provided to the bandpass filter 82. Filters 80 and 82 filter out components of the RF energy which are outside the desired frequency range (in this example 11.2 GHz–12.7 GHz). Hybrid circuit 68 is used to generate vertically polarized transmit signals on circuit line 94 and horizontally polarized RF signals on circuit line 96. These signals are transmitted through diplexers 66 and 78, respectively, through the rotary joint 18, and into the first channel and 38 and second channel 40, respectively, of the first antenna signal processing subsystem 14.

The antenna system 10 thus forms the means by which certain desired components can be located exteriorly of the mobile platform and closely adjacent the main reflector 20 to maximize antenna performance. Still other components are disposed interiorly of the mobile platform to provide easy access for service and maintenance purposes. The antenna system 10 allows a 2 channel rotary coaxial joint to be employed, which is much smaller in overall height, than a conventional waveguide joint. The coaxial rotary joint 18 comprises a height of about 1 inch as compared to a height of about 5 inches for a conventional waveguide joint.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

What is claimed is:

1. A reflector antenna adapted for use on a mobile platform, comprising:

a main reflector having an aperture at its axial center;

a subreflector spaced forwardly of said main reflector;

a support structure for supporting said subreflector fixedly relative to said main reflector;

a feed horn disposed within said aperture such that a first portion of said feedhorn projects forwardly of said main reflector and a second portion of said feedhorn projects rearwardly of said main reflector; and an antenna electronics subsystem for processing at least one of signals sent to or received by said feedhorn, and being disposed closely adjacent said main reflector so as to be disposed exteriorly of said mobile platform, wherein the antenna electronics subsystem comprises:

a first antenna signal processing subsystem including a vertical and horizontal polarization signal processing subsystem for processing signals sent to or received by said feedhorn and being disposed closely adjacent said main reflector so as to be disposed exteriorly of said mobile platform; and a second antenna signal processing subsystem including a transmit and receive subsystem in communication with said first antenna signal processing subsystem for processing signals sent to and received from said first antenna signal processing subsystem, and being disposed interiorly of said mobile platform.

2. The reflector antenna of claim 1, wherein said antenna further comprises:

a rotary coaxial joint mounted on an exterior surface of said mobile platform and coupled to said antenna electronics subsystem, wherein said rotary coaxial joint couples said first and second antenna signal processing subsystems.

3. The reflector antenna of claim 1, wherein said antenna electronics subsystem comprises an ortho mode transducer for splitting a signal received by said feedhorn into vertically and horizontally polarized RF energy.

4. The reflector antenna of claim 1, wherein said antenna electronics subsystem comprises at least one diplexer in communication with said feed horn for splitting transmit and receive signals being communicated simultaneously to and from said feedhorn.

5. The reflector antenna of claim 1, wherein said antenna electronics subsystem comprises at least one low nose amplifier (LNA) for amplifying signals received by said feedhorn.

6. The reflector antenna of claim 1, wherein said first antenna signal processing subsystem comprises at least one diplexer for splitting transmit and receive signals being communicated to and from said antenna electronics subsystem.

7. The reflector antenna of claim 6, wherein said first antenna signal processing subsystem further comprises:

a high power amplifier for amplifying transmit signals communicated to said diplexer.

8. A reflector antenna adapted for use on a mobile platform, comprising:

a main reflector having an aperture at its axial center;

a subreflector spaced forwardly of said main reflector;

a feed horn disposed within said aperture such that a first portion of said feedhorn projects forwardly of said main reflector and a second portion of said feedhorn projects rearwardly of said main reflector; and a first antenna signal processing subsystem having a vertical and horizontal polarization signal processing subsystem for processing signals sent to or received by said feedhorn, and being disposed closely adjacent said main reflector so as to be disposed exteriorly of said mobile platform;

a second antenna signal processing subsystem having a transmit and receive subsystem in communication with said first antenna signal processing subsystem, and being disposed interiorly of said mobile platform, for processing signals sent to and received from said first antenna signal processing system; and a rotary joint disposed on an exterior surface of said mobile platform for coupling said first and second antenna signal processing subsystems.

9. The reflector antenna of claim 8, wherein said first antenna signal processing subsystem comprises:

an ortho mode transducer for splitting signals received by said feedhorn into vertically and horizontally polarized RF energy, wherein:

said vertical polarization signal processing subsystem is in communication with said ortho mode transducer for processing vertically polarized RF energy communicated to or receive from said ortho mode transducer; and said horizontal polarization signal processing subsystem is in communication with said ortho mode transducer for processing horizontally polarized RF energy communicated to or received from said ortho mode transducer.

10. The reflector antenna of claim 9, wherein said transmit subsystem comprises:

a phase shifter disposed within said transmit subsystem for imparting a desired degree of phase shift to a transmit signal to be transmitted from said feedhorn;

a high power amplifier for amplifying said transmit signal; and a first diplexer for coupling said transmit subsystem with said rotary coaxial joints, wherein said receive subsystem comprises:

a second diplexer for coupling said receive subsystem with said rotary coaxial joint; and a bandpass filter responsive to signals from said second diplexer for filtering out signals received from said rotary coaxial joint that are outside of a desired frequency band.

11. A reflector antenna adapted for use on a mobile platform, comprising:

a main reflector having an aperture at its axial center;

a subreflector spaced forwardly of said main reflector;

a feed horn disposed within said aperture such that a first portion of said feedhorn projects forwardly of said main reflector and a second portion of said feedhorn projects rearwardly of said main reflector;

a first antenna signal processing subsystem for processing signals sent to or received by said feedhorn, and being disposed closely adjacent said main reflector so as to be disposed exteriorly of said mobile platform;

said first antenna signal processing subsystem including:

an ortho mode transducer in communication with said feedhorn for splitting RF signals received by said feedhorn into vertically polarized and horizontally signals;

a first pair of diplexers for processing said horizontally polarized signals;

a second pair of diplexers for processing said vertically polarized signals;

a second antenna signal processing subsystem in communication with said first antenna signal processing subsystem, and being disposed interiorly of said mobile platform, for processing signals sent to and received from said first antenna signal processing system;

said second antenna signal processing subsystem including a third pair of diplexers for processing transmit signals being sent to said first antenna processing subsystem and for processing receive signals received from said first antenna processing subsystem; and a rotary coaxial joint disposed on said an exterior surface of said mobile platform for coupling said first and second antenna signal processing subsystems to allow bidirectional communication between said first and second antenna signal processing subsystems.

12. The reflector antenna of claim 11, wherein each of said diplexers operates to split signals passing therethrough into one of said receive signals and said transmit signals based on a frequency of said receive signals and said transmit signals.

13. The reflector antenna of claim 11, wherein said rotary coaxial joint comprises a two channel joint for providing separate channels for vertically polarized signals and horizontally polarized signals.

14. The reflector antenna of claim 11, wherein said second antenna processing subsystem comprises a transmit subsystem and a receive subsystem.

15. The reflector antenna of claim 14, wherein said transmit subsystem comprises a high power amplifier for amplifying said transmit signals being communicated to said first antenna signal processing subsystem.

16. The reflector antenna of claim 14, wherein said receive subsystem includes a bandpass filter for rejecting signal outside of a desired frequency range.

17. A method for forming a reflector antenna adapted for use on a mobile platform, the method comprising:

disposing a main reflector having an aperture at its axial center exteriorly of said mobile platform;

disposing a subreflector spaced forwardly of said main reflector;

disposing a feedhorn within said aperture such that a first portion of said feedhorn projects forwardly of said main reflector and second portion of said feedhorn projects rearwardly of said main reflector; and using a transducer to split signals received by said feedhorn into vertically polarized signals and horizontally polarized signals;

using a first antenna signal processing subsystem including a vertical polarization signal processing subsystem for processing said vertically polarized signals and horizontal polarization signal processing subsystem for processing said horizontally polarized signals being communicated to and from said transducer;

using a second antenna signal processing subsystem disposed interiorly of said mobile platform, and in communication with said first antenna signal processing subsystem, for forming a transmit subsystem and a receive subsystem, said transmit subsystem being operable to phase shift and amplify transmit signals being sent to said first antenna signal processing subsystem, and said receive subsystem being operable to filter receive signals being received from said first antenna signal processing subsystem; and using a rotary joint disposed on an exterior surface of said mobile platform for coupling said first and second antenna signal processing subsystems for bidirectional communication of said transmit and receive signals.

18. A reflector antenna adapted for use on a mobile platform, comprising:

a main reflector having an aperture at its axial center;

a subreflector spaced forwardly of said main reflector;

a support structure for supporting said subreflector fixedly relative to said main reflector;

a feedhorn disposed within said aperture such that a first portion of said feedhorn projects forwardly of said main reflector and a second portion of said feedhorn projects rearwardly of said main reflector;

an antenna electronics subsystem for processing at least one of signals sent to or received by said feedhorn, and being disposed closely adjacent said main reflector so as to be disposed exteriorly of said mobile platform; and a rotary coaxial joint mounted on an exterior surface of said mobile platform and coupled to said antenna electronics subsystem, said rotary coaxial joint having a predetermined height;

wherein the antenna electronics subsystem comprises:

a first antenna signal processing subsystem including a vertical and horizontal polarization signal processing subsystem for processing signals sent to or received by said feedhorn and being disposed closely adjacent said main reflector so as to be disposed exteriorly of said mobile platform; and a second antenna signal processing subsystem including a transmit and receive subsystem in communication with said first antenna signal processing subsystem for processing signals sent to and received from said first antenna signal processing subsystem, and being disposed interiorly of said mobile platform.

19. The reflector of claim 18, wherein the height of said rotary coaxial joint is no more than approximately 2 inches.

* * * * *